US005934985A

United States Patent [19]

Clowers et al.

[11] Patent Number: 5,934,985

[45] **Date of Patent: *Aug. 10, 1999**

[54] PALM GRIP RANDOM ORBIT SANDER WITH LOWER HOUSING AND DUST COLLECTOR COUPLED TO LOWER HOUSING

[75] Inventors: Earl R. Clowers; John W. Schnell, both of Jackson, Tenn.

[73] Assignee: Porter Cable Corporation, Jackson, Tenn.

[ * ] Notice: This patent is subject to a terminal disclaimer.

[21] Appl. No.: 08/954,452

[22] Filed: Oct. 20, 1997

Related U.S. Application Data

[63] Continuation of application No. 08/613,147, Mar. 8, 1996, Pat. No. 5,791,977, which is a continuation of application No. 08/334,855, Nov. 4, 1994, Pat. No. 5,518,442, which is a continuation of application No. 08/009,309, Jan. 22, 1993, abandoned.

[51] Int. Cl.[6] ..... B24B 23/03

[52] U.S. Cl. ..... 451/357; 451/359; 451/453; 451/456

[58] Field of Search ..... 451/344, 353, 451/357, 359, 453, 456; 55/523

[56] References Cited

U.S. PATENT DOCUMENTS

| | | |
|---|---|---|
| Re. 29,247 | 6/1977 | Kilstrom et al. . |
| D. 326,398 | 5/1992 | Fushiya et al. . |
| 2,499,933 | 3/1950 | Smul . |
| 2,895,266 | 7/1959 | Statler . |
| 2,929,177 | 3/1960 | Sheps . |
| 3,123,946 | 3/1964 | Hoveland . |
| 3,594,958 | 7/1971 | Cusumano . |
| 3,673,744 | 7/1972 | Oimoen . |

(List continued on next page.)

FOREIGN PATENT DOCUMENTS

| | | |
|---|---|---|
| 931761 | 8/1973 | Canada . |
| 1032349 | 6/1978 | Canada . |
| 1049265 | 2/1979 | Canada . |
| 1063806 | 10/1979 | Canada . |
| 1080477 | 7/1980 | Canada . |
| D. 3602571 A1 | 7/1987 | Germany . |
| D. 3702-960 | 8/1988 | Germany . |
| 55-112759 | 8/1980 | Japan . |
| 747-700 | 7/1980 | Russian Federation . |
| 1408522 | 10/1975 | Sweden . |
| 85/01004 | 3/1985 | WIPO . |

OTHER PUBLICATIONS

Brochure entitled "Porex Porous Plastic Materials", Porex Technologies, Fairburn, Georgia, 1990.

Brochure entitled "An Introduction to Interflo", Interflo, a Division of Chromex Corporation, Brooklyn, New York.

Nagyszalanczy, Random–Orbit Sanders, *Fine Woodworking,* Jul./Aug. 1993 pp. 43–47.

Catalog entitled "Black & Decker Industrial Construction Division, Heavy Duty Professional Power Tools & Accessories for Construction and Industry", The Black & Decker Corporation, Towson, Maryland, p. 48.

*Primary Examiner*—Eileen P. Morgan
*Attorney, Agent, or Firm*—Merchant & Gould P.C.

[57] ABSTRACT

A pad sander skirt which flares out over the periphery of the sanding pad and which is coupled to a lower housing so that it swivels about the body of the sander. The skirt and lower housing can be selectively swivelled in a rotational manner to a position desired by the user. A further sander improvement disclosed relates to the protection of a user's hand. Palm-grip random orbit sanders are sometimes configured so that the sanding pad may begin spinning at high speed when the sander is lifted off of the work. To this end, the present application discloses a protective skirt which flares out over the periphery of the pad in a palm-grip random orbit sander. Also disclosed is an improved dust collection system comprising a filter housing formed of a rigid porous material for entrapping dust.

38 Claims, 6 Drawing Sheets

U.S. PATENT DOCUMENTS 3,785,092 1/1974 Hutchins .
3,824,745 7/1974 Hutchins .
3,826,045 7/1974 Champayne .
3,862,521 1/1975 Isaksson .
3,938,283 2/1976 Keith, Jr. .
3,964,212 6/1976 Karden .
3,987,589 10/1976 Marton .
4,062,152 12/1977 Mehrer .
4,071,981 2/1978 Champayne .
4,135,334 1/1979 Rudiger .
4,158,935 6/1979 Robert .
4,164,101 8/1979 Robert .
4,322,921 4/1982 Maier .
4,328,645 5/1982 Sauer .
4,616,449 10/1986 Marton .
4,671,019 6/1987 Hutchins .
4,754,575 7/1988 Schneider .
4,759,152 7/1988 Berger et al. .
4,851,730 7/1989 Fushiya et al. .
4,899,495 2/1990 Attinger et al. .
4,967,516 11/1990 Hoshino et al. .
5,018,314 5/1991 Fushiya et al. .
5,125,190 6/1992 Buser et al. .
5,206,967 5/1993 Fushiya et al. .
5,218,790 6/1993 Huang ..... 451/456
5,237,781 8/1993 Demetrius .
5,261,190 11/1993 Berger et al. .
5,384,984 1/1995 Smith .
5,518,442 5/1996 Clowers et al. .

PALM GRIP RANDOM ORBIT SANDER WITH LOWER HOUSING AND DUST COLLECTOR COUPLED TO LOWER HOUSING

CROSS-REFERENCE TO RELATED APPLICATIONS

This application is a continuation of U.S. application Ser. No. 08/613,147, filed Mar. 8, 1996 now U.S. Pat. No. 5,791,977. Application Ser. No. 08/613,147 is a continuation of application Ser. No. 08/334,855, filed Nov. 4, 1994, now U.S. Pat. No. 5,518,442. Application Ser. No. 08/334,855 was a continuation of application Ser. No. 08/009,309, filed Jan. 22, 1993, now abandoned. Each of these applications is incorporated herein by reference.

BACKGROUND AND SUMMARY OF THE INVENTION

The present application is directed to sander improvements. These improvements include a pad sander lower housing having a skirt which flares out over the periphery of the sanding pad. The lower housing can be selectively swivelled in a rotational manner to a position desired by the user. This has particular advantages in dustless versions of a sander in which it may be desirable to reposition the dust collection system.

A further improvement relates to the protection of a user's hand. Palm-grip random orbit sanders sometimes are configured so that the sanding pad may begin spinning at high speed when the sander is lifted off of the work. Since palm-grip random orbit sanders can be grasped by a single hand in a manner that might put the user's fingers in contact with a high speed spinning pad, protection against injury is desirable. To this end, the present application discloses a protective skirt which flares out over the periphery of the pad in a palm-grip random orbit sander. The skirt may be configured for either dustless versions of such sanders, in which case the skirt typically also forms a portion of the dust collection system, as well as with dusty versions of the sander, in which case the primary purpose of the skirt is to prevent contact of the user's hand and fingers with the pad.

In sanders with dust collectors, particularly those that use passive systems such as a cloth bag to catch dust, the dust collection apparatus can be both relatively cumbersome and ineffective. In an improvement to such passive systems, the present application discloses a sander dust collector filter housing formed of a rigid, porous material for entrapping dust. Such a dust collection system can be made in a compact manner which is particularly suitable for palm-grip sanders, whether the sander be of an orbital, dual action, or random orbit type. Larger versions of such filter housings may be used with larger sanders.

DETAILED DESCRIPTION OF THE PREFERRED EMBODIMENT

Figure 1:
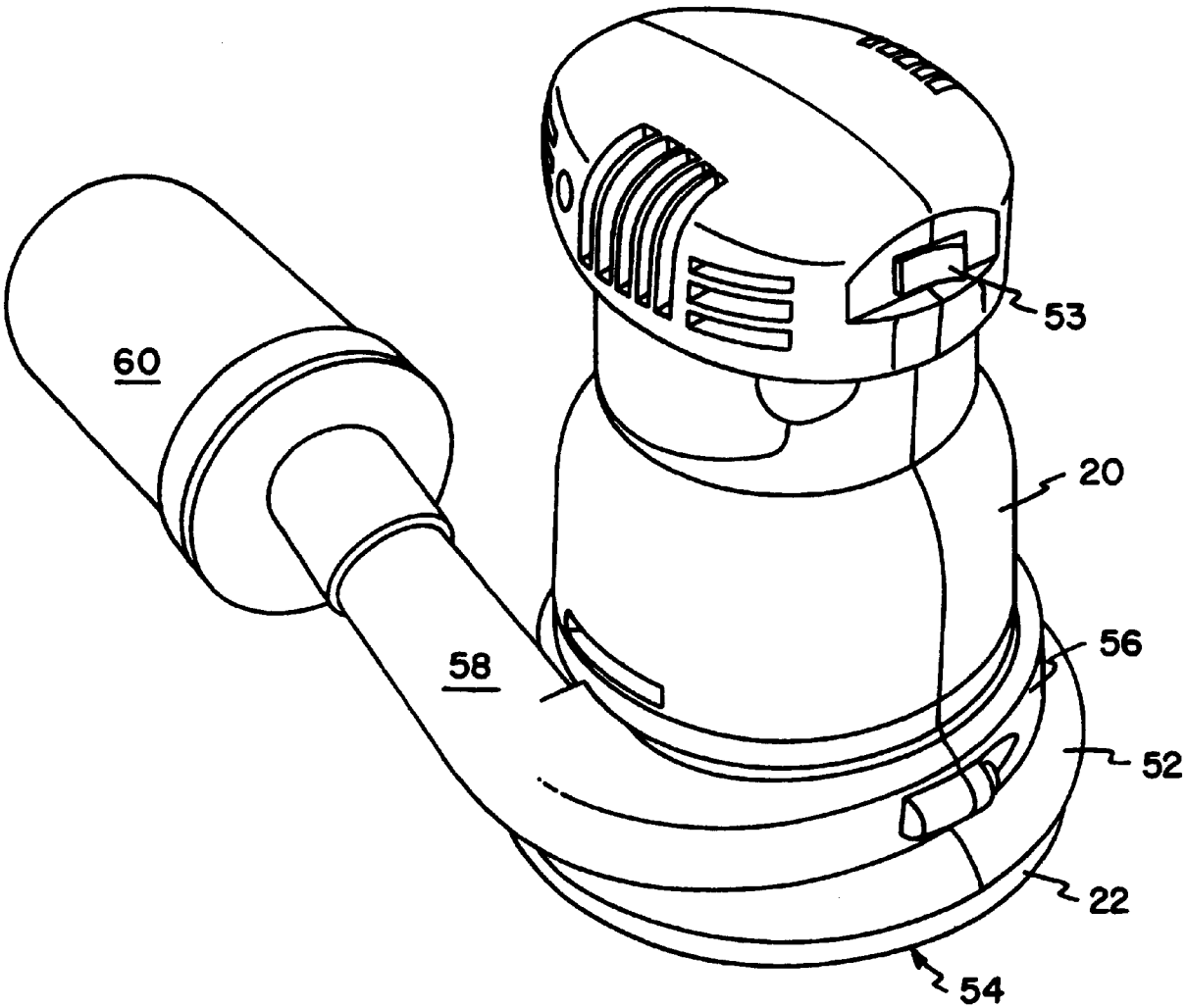
FIG. 1 is a perspective view of a sander which incorporates a dust collection system.
Figure 1A:
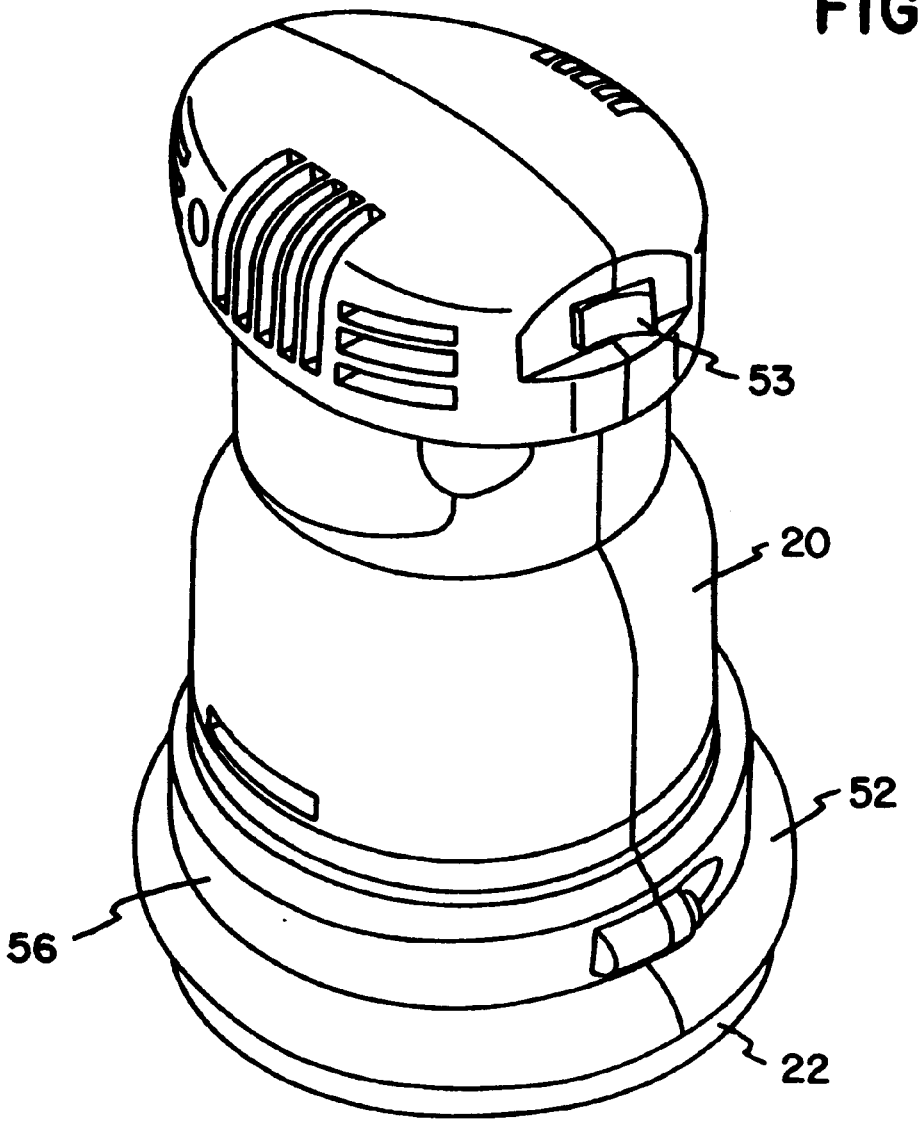
FIG. 1A illustrates a similar sander without a dust collection system.

FIG. 1 illustrates a sander having a body or housing 20 which is typically comprised of two halves secured together by conventional means and a pad 22 for holding sandpaper or other abrasives or materials (e.g., polishing pads) desired by the user. Such pads 22 can be configured in the pressure sensitive adhesive (PSA) variety as well as a hook and loop variety, each of which are familiar to those skilled in the art, and can be either with or without holes to incorporate either a sander with dust collection capability (for example, as shown in FIG. 1) or without such capability (for example, as shown in FIG. 1A). Pad 22 has an outer periphery substantially defining the size of sandpaper or other material supported by the pad.

The sander shown in FIGS. 1 and 1A have a body or housing 20 sized for a palm grip at the top of the housing and for a single-handed grip around the body. A motor housed by body 20 typically comprises an armature 24, a field 26, and brush and spring assemblies 28. Upper and lower ball bearings 30 and 32 are supported by the housing and provide stability and smooth operation for motor shaft 34. For a random orbit sander of the type shown, motor shaft 34 is typically directly coupled to a counterweight 36, which may incorporate integral fan blades 37 used for dust collection.

In the embodiment shown, pad support 38 is coupled to counterweight 36 by a ball bearing 40 having its outer race diameter press fit into a cylindrical cavity 42 defined by pad support 38 and the inner diameter of its race slip fit onto an eccentrically-located cylindrical protrusion 44 of counterweight 36. The connection between counter-weight 36 and pad support 38 imparts an orbital motion to the pad support 38. Pad support 38 is shown further secured to armature shaft 34 by a machine screw 46, which ensures a secure assembly of the counterweight 36, bearing 40 and pad support 38. Pad 22 is typically secured to pad support 38 by threaded machine screws 48.

Figure 3:
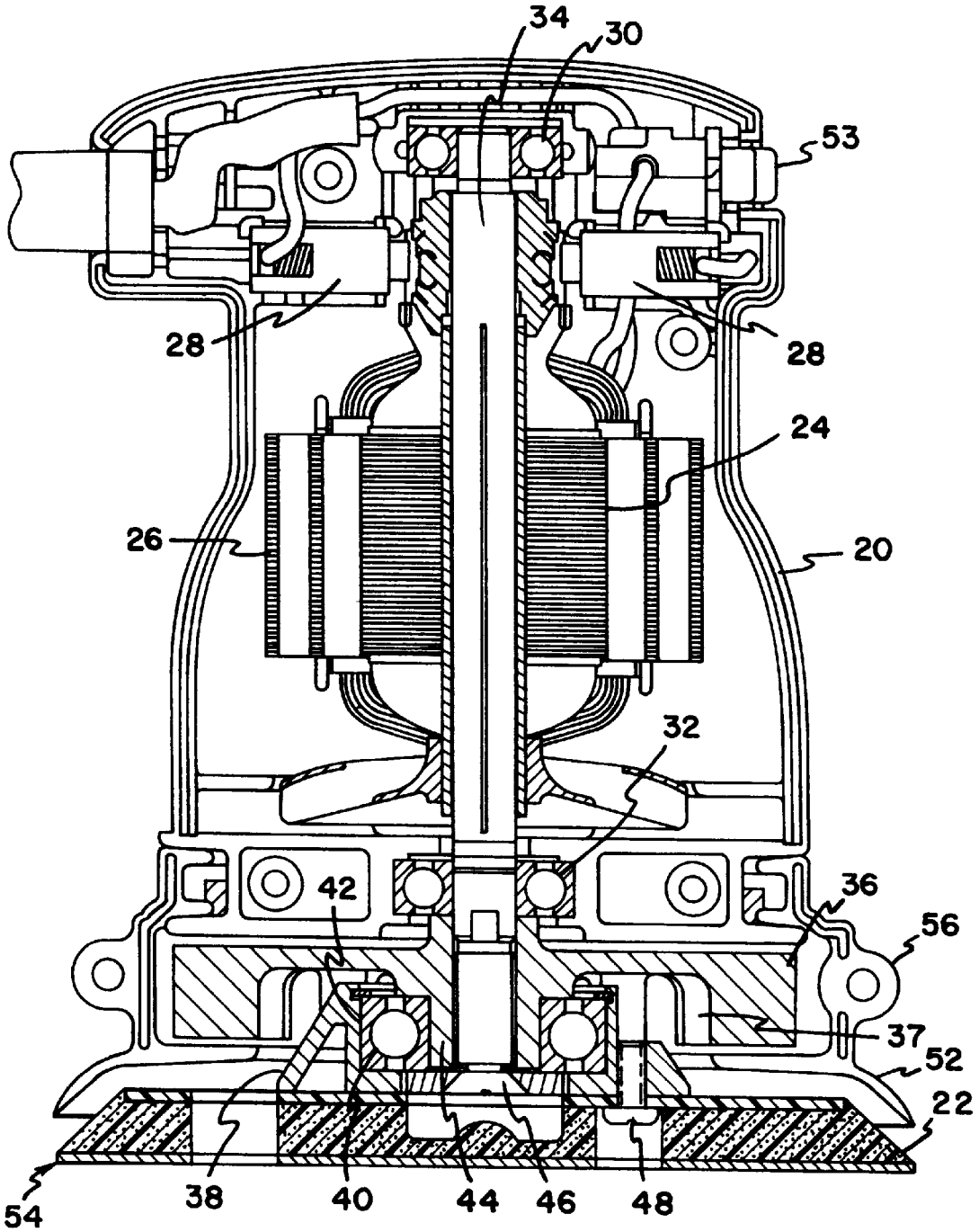
FIG. 3 shows a cross-sectional view of a sander.

As has previously been indicated, the sander motor in the embodiment shown is powered electrically and for this purpose includes a power cord 50 with power being controlled by an on/off switch 53. Those skilled in the art will recognize many other components illustrated in the cross-section of FIG. 3 as being typical to the assembly of an electrically-driven sander of a random orbit nature. Those skilled in the art will also recognize that suitable components of the sander shown could be replaced with well-known components if a sander of the orbital or dual-action variety is desired. Furthermore, in embodiments driven by an air motor, power cord 50 would be replaced by an air hose, and the components previously described which relate an electric motor would be replaced with suitable air motor components. Motors used in the preferred embodiments have a typical no-load speed of 12,000 RPM.

For the preferred random orbit sanders shown in the present application, when a sander is not in contact with the work, the rotational restraint established between the inner race, balls, seals, grease, and the outer race of the bering 40 causes the pad assembly to spin at the same speed as the motor shaft. When the abrasive or other material mounted to pad 22 contacts the work, another rotational restraint is created which opposes the bearing restraint. This additional restraint varies with pressure, abrasive grade, etc. Through this process, the rotational speed of pad 22 (i.e., of the outer race of bearing 40) is reduced to approximately 300 RPM, while the orbital motion (inner race of bearing 40) continues at a higher speed (12,000 OPM). In this manner, since the rotational speed of the pad is not synchronized with the orbital motion of the pad, the abrasive particles are made to travel in a "random orbital motion."

The sanders shown in the present application comprise a skirt 52 which flares out over the periphery 54 of pad 22. As with housing 20, skirt 52 is preferably formed of a rigid material (for example, polyamide) and is spaced slightly upward from pad 22, giving pad 22 sufficient clearance from skirt 52 so that the sander can operate properly and so that dust can be pulled up between the periphery of pad 22 and skirt 52 by fan blades 37. As previously indicated, fan blades 37 may be integrally formed in a central open region interior to counterweight 36.

In the preferred embodiment, skirt 52 is formed integrally with a lower housing 56, which is configured so that it can be selectively rotated about sander body 20 for enabling the lower housing to be oriented in a position desired by the user. The position selected by the user is typically maintained by friction between the exterior lower portion of the sander body 20 and the interior portion of lower housing 56, each of which have complementary shapes to ensure retention of the lower housing on the sander body while enabling rotational adjustment. The ability to adjustably position lower housing 56 is particularly advantageous when lower housing 56 comprises a dust collection system defining a dust exhaust channel such as 58. Such a dust exhaust channel may be coupled either to a passive dust collector such as a bag or filter housing 60 or by a hose to an active system such as a vacuum cleaner. In these scenarios, users may wish to adjust the position of the collection system with respect to sander or workpiece features.

Figure 2:
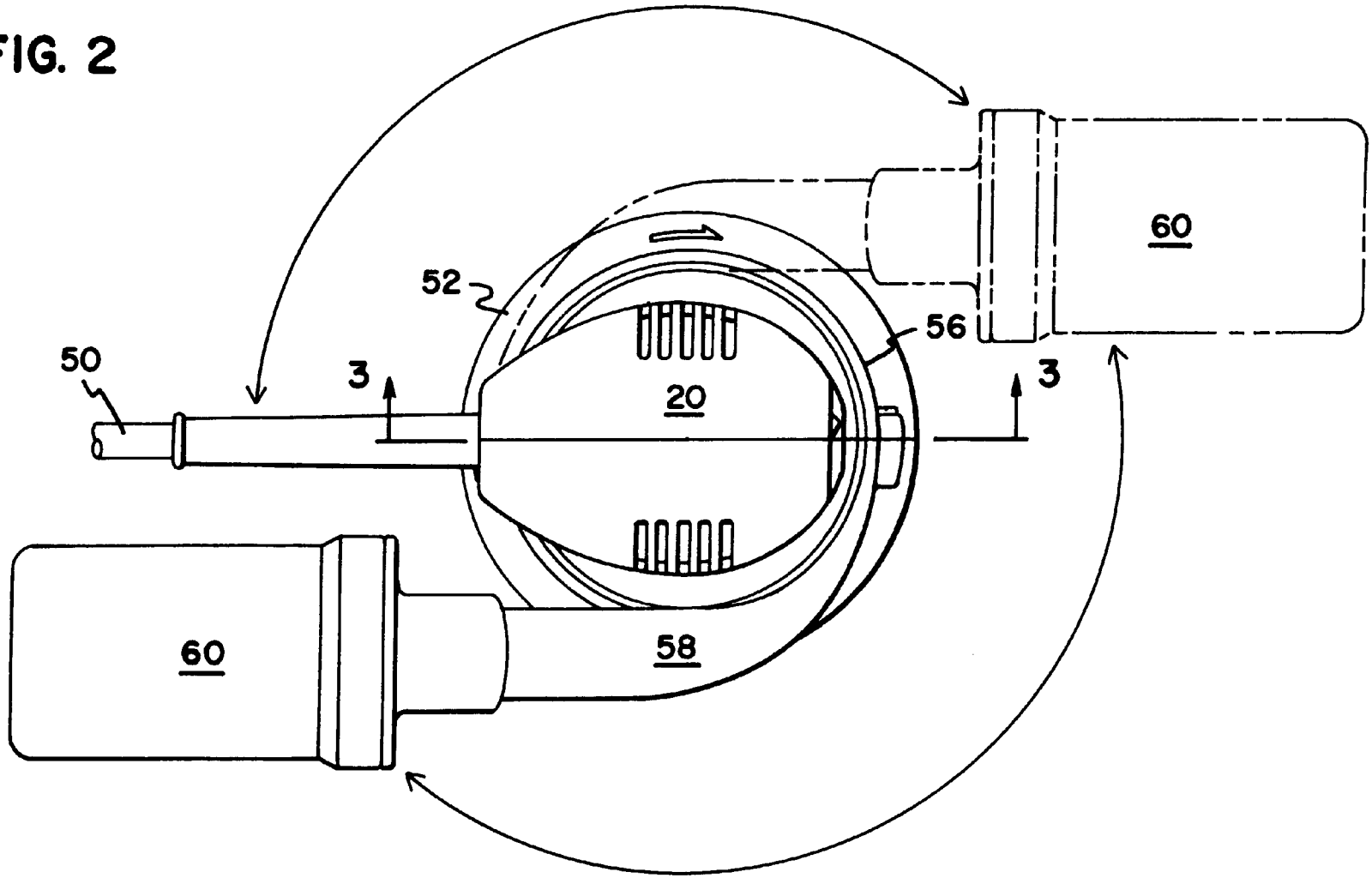
FIG. 2 is a top view of a sander showing a dust collection system which can be rotationally oriented in a direction selected by the user.

As with body 20, lower housing 56 may comprise two halves secured together by conventional means. For the version of the sander disclosed which incorporates dust collection, dust collection channel 58 is defined in part by a portion of lower housing 56. FIG. 2, which is a top plan view of the preferred sander embodiment comprising a passive dust collection system, illustrates how lower housing 56 may be selectively swivelled in a rotational manner to a position desired by the user. As can be seen, such positioning will enable the user to orient the direction of exhaust port 58 in a preferred direction relative to, for example, power cord 50.

Figure 4:
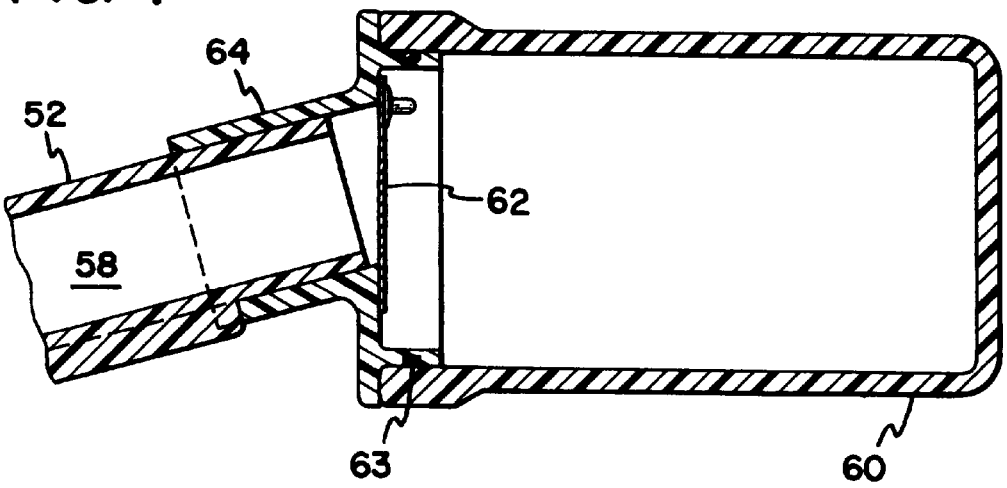
FIG. 4 illustrates a dust collection housing.
Figure 5:
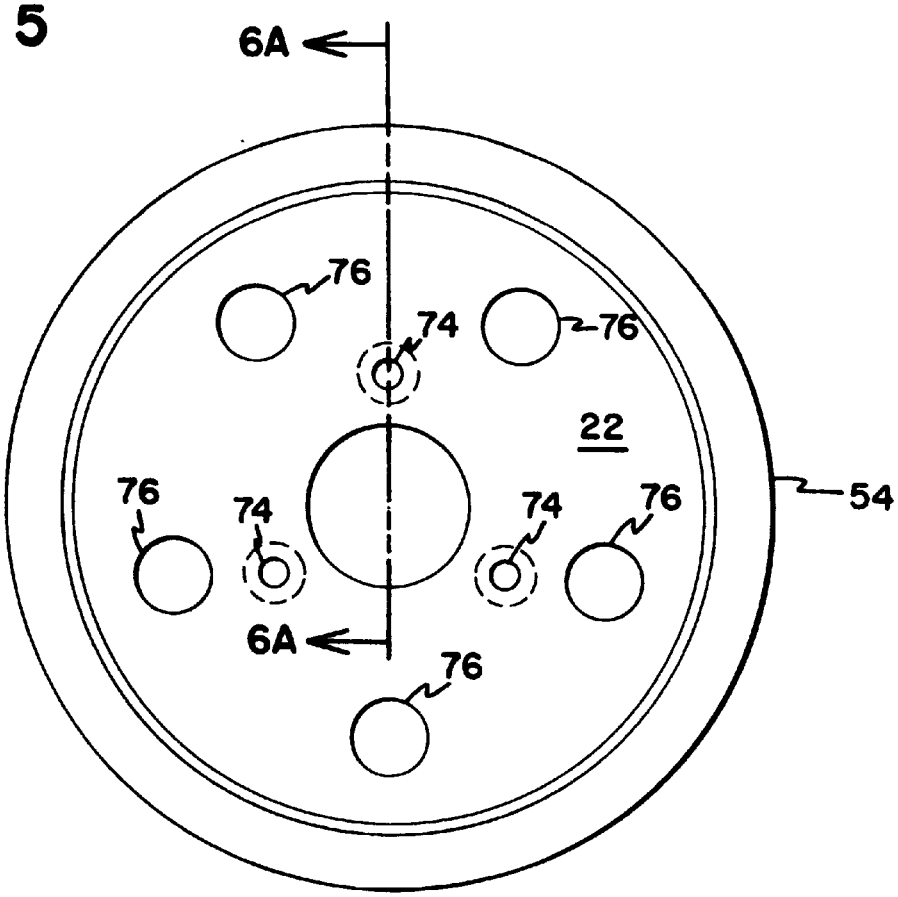
FIG. 5 illustrates a top plan view of a sanding pad which incorporates dust collection holes.
Figure 6A:
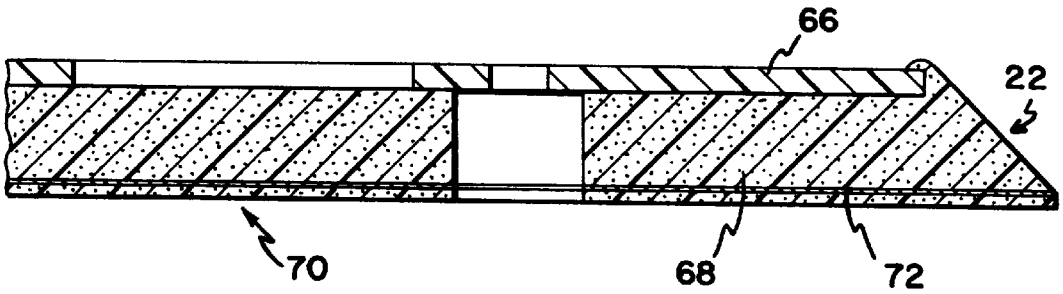
FIG. 6A and 6B illustrate alternative embodiments of a sander back-up pad.
Figure 6B:
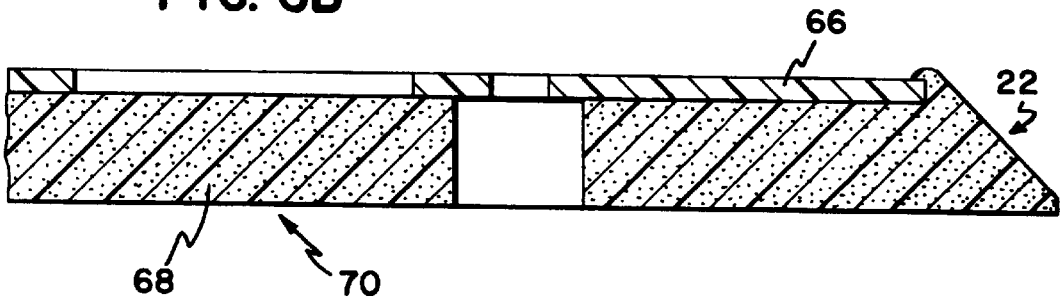

The preferred dust collection system is shown cross-sectionally in FIG. 4. Note that the preferred system incorporates a membrane 62 which maintains a normally closed position in order to prevent the back flow of dust collected within filter 60 while enabling dust to enter the filter. Membrane 62 may be formed of polyester film having a nominal thickness of 0.007 inch. Filter housing 60 is typically coupled via friction fit to an adapter 64, which in turn fits fictionally over dust exhaust channel 58 of housing 52 in order to removably interconnect the filter and adapter assembly with the sander exhaust port. O-ring 63 retained in place by a detent in adapter 64 helps maintain a good friction fit and seal for enabling long-life and easy removal of housing 60 from adapter 64. When filter housing 60 is full of dust, it can be removed from adapter 64 and emptied by simply twisting housing 60 off of adapter 64 and tapping the filter housing briefly in order to empty it of dust. Note that, during this emptying procedure, membrane 62 preferably remains with adapter 64 and does not interface with emptying filter housing 60.

In the preferred embodiment, filter housing 60 is formed by molding, sinterring or by other means a rigid, porous, plastic material, preferably porous polyethylene, polypropylene, polystyrene, or other polyolefins having a pore size effective to retain sanding dust; it has been found that a pore size of 120–140 microns is satisfactory. In the embodiment shown, filter housing 60 is substantially cylindrical and has an internal diameter of approximately two inches, a length of approximately four inches, and a typical wall thickness of 0.15 inch. Those skilled in the art will recognize that other sizes and shapes of sander filters consistent with the present filter invention may also be useful.

In the sander embodiments shown, pads 22 are typically five inches in diameter and comprise an upper member 66 of fiberglass-reinforced epoxy molded into a lower member 68, which may be formed of integral skin-cast polyurethane. As is familiar to those skilled in the art, for pads used with PSA, a vinyl sheet is typically applied to the lower surface 70 of lower pad member 68. This vinyl material is normally coated such that PSA sandpaper or the like will stick to the surface and yet, when the paper is removed, little or not abrasive will be present on the vinyl sheet. Pads 22 are typically rated for 13,000 RPM. PSA pads with lower surface 70 formed of vinyl or similar material may include an embossed grain applied in a mold (a surface familiar to those skilled in the art used with pressure-sensitive adhesive for adhering materials such as abrasive sheets to the pad). Alternatively, lower surface 70 may be formed of short-stemmed hook and loop material applied in the mold (a surface likewise familiar to those skilled in the art for use in connection with abrasive sheets or the like backed with hook and loop material).

In prior-art sander configurations operating in the random orbit mode, pad 22 is typically free of rotational restraint such that pad 22 may achieve a very high RPM when the motor is running and the sander is lifted off of the work. In such situations, if lower member 68 of pad 22 is formed of typical prior-art materials such as cast polyurethane foam, the pad may expand radially outward. Radial pad expansion in this manner can cause a sanding sheet adhered to the bottom face 70 of the pad to be released when PSA is used to bond the abrasive sheet to the pad. This release of the adhesive sheet has been found to be caused by the differential movement in the interface between bottom surface 70 of the pad and the adjoining layer of the adhesive sheet, resulting in release by the PSA of the sanding sheet. Such released abrasive sheets can be inconvenient to the user.

Accordingly, it has been found that use of an anti-radial-expansion mechanism coupled proximate the lower surface 70 of sanding pad member 68 can substantially prevent radial expansion of the pad and substantially eliminate the problem of PSA bonding failures between the pad and the adhesive sheet. In one preferred embodiment, the anti-radial-expansion system is achieved by molding a layer 72 of vinyl-coated fiberglass insect screening into the lower portion of pad member 68. Such insect screening may have a mesh of 18 by 16 strands per inch with a strand diameter of 0.011 inch. Other similar fiberglass screening or materials may also be used in order to prevent the previously described radial expansion problem. An alternative is use of a square-weaved cloth backing molded into the vinyl coating at the bottom of the pad.

Pads 22 are typically secured to pad support 38 by machine screws 48 passed through mounting holes 74 formed in upper fiberglass member 66. In sanding pads which comprise vacuum holes 76, the vacuum holes are preferably molded in and not machined.

At the time of filing the present application, preferred embodiments of the sanders disclosed can be obtained from Porter-Cable Corporation, the assignee of the present application, in three models. A model 332 does not incorporate dust collection and includes a PSA pad. A model 333 includes a dust collection system as well as a hook and loop pad. A model 334 is similar to the model 333 except that it incorporates a PSA pad.

The present invention is to be limited only in accordance with the scope of the appended claims, since persons skilled in the art may devise other embodiments still within the limits of the claims.

What is claimed is:

1. A palm grip random orbit sander comprising:

a sander body, a pad for supporting sandpaper, a motor housed by the sander body, and a random orbit coupler system which couples the motor to the pad to impart a random orbit sanding motion to the pad, the sander body being sized for a palm grip on a top of the sander body;

a lower housing coupled to the sander body, the lower housing being arranged and configured to swivel relative to the sander body; and a dust collector coupled to the lower housing, wherein a user can adjust a rotational orientation of the dust collector relative to the sander body by manually swiveling the lower housing relative to the sander body.

2. The sander of claim 1, wherein the lower housing defines at least a portion of a dust exhaust channel and the dust collector is coupled to the dust exhaust channel.

3. The sander of claim 1, wherein the lower housing has an interlocking complementary shape with respect to the sander body so as to be coupled to the sander body (i) with a frictional fit in a manner enabling the lower housing to be selectively swiveled rotationally by sliding the sander body against the frictional fit relative to the lower housing to a position desired by the user, and (ii) to prevent the lower housing and the sander body from being removably separated from each other when the user is selectively swiveling the lower housing about the sander body.

4. The sander of claim of 1, wherein the lower housing can be swiveled without the use of a tool.

5. The sander of claim 2, wherein the dust exhaust channel extends outward from the lower housing.

6. The sander of claim 1, further comprising a counterweight coupled to the motor and housed within the lower housing, the counterweight including a plurality of fan blades adapted for use in dust collection.

7. The sander of claim 4, wherein the lower housing is retained in the desired rotational position relative to the sander body by friction.

8. The sander of claim 1, wherein the lower housing includes two half pieces that when interconnected interlock with the sander body such that the lower housing and the sander body are prevented from being removably separated from each other when the user is selectively swiveling the lower housing about the sander body.

9. The sander of claim 1, wherein the lower housing is made of a plastic material.

10. A palm grip random orbit sander comprising:

a sander body, a pad for supporting sandpaper, a motor housed by the sander body, and a random orbit coupler system which couples the motor to the pad to impart a random orbit sanding motion to the pad, the sander body being sized for a palm grip on a top of the sander body; and a lower housing coupled to the sander body, the lower housing being arranged and configured to swivel relative to the sander body, and the lower housing defining a dust collection channel that extends outward from a main body of the lower housing, wherein a user can adjust a rotational orientation of the dust collection channel relative to the sander body by manually swiveling the lower housing relative to the sander body.

11. The sander of claim 10, further comprising a passive dust collector adapted to be secured to the dust collection channel.

12. The sander of claim 10, wherein the lower housing has an interlocking complementary shape with respect to the sander body so as to be coupled to the sander body (i) with a frictional fit in a manner enabling the lower housing to be selectively swiveled rotationally by sliding the sander body against the frictional fit relative to the lower housing to a position desired by the user, and (ii) to prevent the lower housing and the sander body from being removably separated from each other when the user is selectively swiveling the lower housing about the sander body.

13. The sander of claim 10, wherein the lower housing can be swiveled without the use of a tool.

14. The sander of claim 10, further comprising a counterweight coupled to the motor and housed within the lower housing, the counterweight including a plurality of fan blades adapted for use in dust collection.

15. The sander of claim 13, wherein the lower housing is retained in the desired rotational position relative to the sander body by friction.

16. The sander of claim 10, wherein the lower housing includes two half pieces that when interconnected interlock with the sander body so as to prevent the lower housing and the sander body from being removably separated from each other when the user is selectively swiveling the lower housing about the sander body.

17. The sander of claim 10, wherein the lower housing is made of a plastic material.

18. A palm grip random orbit sander comprising:

an upper housing including a top portion sized and shaped for a palm grip;

a motor housed by the upper housing, the motor including a motor shaft;

a counterweight connected to the motor shaft, the counterweight including a plurality of fan blades for use in dust collection, the counterweight also including an eccentrically located protrusion;

a bearing having an inner race and an outer race, the inner race being mounted on the protrusion of the counterweight;

a pad holder mounted on the outer race of the bearing;

a pad secured to the pad holder, the pad defining a plurality of vacuum holes for use in dust collection; and a lower housing coupled to the upper housing, the lower housing being arranged and configured to swivel relative to the upper housing, the lower housing at least partially housing the counterweight, and the lower housing defining a dust collection port adapted for connection to a dust collector, wherein a user can adjust a rotational orientation of the dust collection port relative to the upper housing by manually swiveling the lower housing relative to the upper housing without requiring a tool to loosen a connection between the lower housing and the upper housing.

19. The sander of claim 18, further comprising a passive dust collector adapted to be connected to the dust collection port.

20. The sander of claim 18, wherein the lower housing has an interlocking complementary shape with respect to the upper housing so as to be coupled to the upper housing (i) with a frictional fit in a manner enabling the lower housing to be selectively swiveled rotationally by sliding the upper housing against the frictional fit relative to the lower housing to a position desired by the user, and (ii) to prevent the lower housing and the upper housing from being removably separated from each other when the user is selectively swiveling the lower housing about the upper housing.

21. The sander of claim 18, wherein the lower housing includes two half pieces adapted to be interconnected with one another, wherein when the two half pieces are interconnected, the half pieces are adapted to interlock with the upper housing to prevent the lower housing and the upper housing from being removably separated from each other when the user is selectively swiveling the lower housing about the upper housing.

22. The sander of claim 18, wherein the upper housing includes a head portion and a neck portion, the neck portion being sized and shaped to receive the user's fingers when the user's palm engages the head portion.

23. A random orbit sander comprising:

a sander body, a pad for supporting sandpaper, a motor housed by the sander body, and a random orbit coupler system which couples the motor to the pad to impart a random orbit sanding motion to the pad; and a lower housing arranged and configured to swivel relative to the sander body, the lower housing defining a dust collection port adapted for connection to a dust collector, wherein a user can adjust a rotational orientation of the dust collection port relative to the sander body by manually swiveling the lower housing relative to the sander body without requiring a tool.

24. The sander of claim 23, further comprising a passive dust collector adapted to be connected to the dust collection port.

25. The sander of claim 23, wherein the lower housing has an interlocking complementary shape with respect to the sander body so as to be coupled to the sander body (i) with a frictional fit in a manner enabling the lower housing to be selectively swiveled rotationally by sliding the sander body against the frictional fit relative to the lower housing to a position desired by the user, and (ii) to prevent the lower housing and the sander body from being removably separated from each other when the user is selectively swiveling the lower housing about the sander body.

26. The sander of claim 23, wherein the lower housing includes at least two separate pieces that when interconnected are adapted to interlock with the sander body to prevent the lower housing from being removed from the sander body.

27. The sander of claim 23, wherein the lower housing is made of a plastic material.

28. The sander of claim 26, wherein the sander body defines one or more slots extending at least partially about a circumference of the sander body, and the lower housing includes one or more portions that project within the slots to provide an interlocked connection between the lower housing and the sander body.

29. The sander of claim 23, further comprising a counterweight coupled to the motor and housed within the lower housing, the counterweight including a plurality of fan blades adapted for use in dust collection.

30. A palm grip random orbit sander comprising:

an upper housing, a pad for supporting sandpaper, a motor at least partially housed by the upper housing, and a random orbit coupler system which couples the motor to the pad to impart a random orbit sanding motion to the pad, the upper housing being sized and shaped for a palm grip on a top of the upper housing; and a lower housing coupled to the upper housing, the lower housing defining a dust collection port adapted for connection to a dust collector, and the lower housing including at least two separate pieces adapted to be interconnected with one another, the at least two separate pieces being arranged and configured to interlock with the upper housing to prevent the lower housing and the upper housing from being removably separated from each other.

31. The sander of claims 30, further comprising a passive dust collector adapted to be secured to the dust collection channel.

32. The sander of claim 30, wherein the lower housing can be manually swiveled with respect to the upper housing.

33. The sander of claim 30, further comprising a counterweight coupled to the motor and housed within the lower housing, the counterweight including a plurality of fan blades adapted for use in dust collection.

34. The sander of claim 33, wherein the counterweight includes an eccentrically located protrusion, and the sander further includes a bearing having an inner race and an outer race, the inner race being mounted on the protrusion of the counterweight, and the outer race being connected to a pad holder adapted for holding the pad of the sander.

35. The sander of claim 30, wherein the at least two pieces of the lower housing include two mating half pieces.

36. The sander of claim 30, wherein the lower housing is made of a plastic material.

37. The sander of claim 30, wherein the upper housing includes a head portion and a neck portion, the neck portion being sized and shaped to receive a user's when the user's palm engages the head portion.

38. The sander of claim 30, wherein the upper housing defines one or more slots extending at least partially about a circumference of the upper housing, and the lower housing includes one or more portions that project within the slots to provide an interlocked connection between the lower housing and the upper housing.

* * * * *

UNITED STATES PATENT AND TRADEMARK OFFICE

CERTIFICATE OF CORRECTION

PATENT NO. : 5,934,985
DATED : August 10, 1999
INVENTOR(S) : Clowers et al.

It is certified that error appears in the above-identified patent and that said Letters Patent is hereby corrected as shown below:

Column 8,
Line 27, "claims" should read -- claim --
Line 48, after first occurrence of "user's" insert -- fingers --

Signed and Sealed this

Twenty-first Day of May, 2002

*Attest:*

*Attesting Officer*

JAMES E. ROGAN
*Director of the United States Patent and Trademark Office*